US010657886B2

(12) United States Patent
Wang

(10) Patent No.: US 10,657,886 B2
(45) Date of Patent: May 19, 2020

(54) PIXEL COMPENSATION CIRCUIT, DRIVING METHOD THEREOF AND DISPLAY DEVICE

(71) Applicant: BOE Technology Group Co., Ltd., Beijing (CN)

(72) Inventor: Li Wang, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 582 days.

(21) Appl. No.: 15/278,864

(22) Filed: Sep. 28, 2016

(65) Prior Publication Data

US 2017/0193908 A1 Jul. 6, 2017

(30) Foreign Application Priority Data

Jan. 4, 2016 (CN) ..... 2016 1 0006381

(51) Int. Cl.
*G09G 3/3233* (2016.01)

(52) U.S. Cl.
CPC ... *G09G 3/3233* (2013.01); *G09G 2300/0819* (2013.01); *G09G 2300/0842* (2013.01); *G09G 2300/0861* (2013.01); *G09G 2310/0297* (2013.01); *G09G 2310/08* (2013.01); *G09G 2320/0219* (2013.01); *G09G 2320/0223* (2013.01); *G09G 2320/0233* (2013.01)

(58) Field of Classification Search
None
See application file for complete search history.

(56) References Cited

U.S. PATENT DOCUMENTS

2005/0174311 A1* 8/2005 Huh ..... G09G 3/3233 345/87
2006/0145968 A1* 7/2006 You ..... G09G 3/3233 345/76
2007/0296672 A1 12/2007 Kim et al.
2008/0170010 A1* 7/2008 Kim ..... G09G 3/3233 345/76

(Continued)

FOREIGN PATENT DOCUMENTS

CN 102005178 A 4/2011
CN 102930824 A 2/2013

(Continued)

OTHER PUBLICATIONS

Sep. 5, 2017—(CN) First Office Action Appn 201610006381.3 with English Tran.

*Primary Examiner* — Amare Mengistu
*Assistant Examiner* — Sarvesh J Nadkarni
(74) *Attorney, Agent, or Firm* — Banner & Witcoff, Ltd.

(57) ABSTRACT

A pixel compensation circuit, a driving method thereof and a display device are provided. The pixel compensation circuit includes: a signal input unit, a driving unit, a light-emitting control unit, a first reset unit, a second reset unit, a first storage capacitor, a first switching transistor and a second switching transistor. When display data are written into the signal input unit, a signal write control line controls the first switching transistor to be switched on. The driving method of the pixel compensation circuit can be applied in the pixel compensation circuit. The pixel compensation circuit can be applied in an OLED display device.

13 Claims, 3 Drawing Sheets

(56) References Cited

U.S. PATENT DOCUMENTS

| | | | | |
|---|---|---|---|---|
| 2010/0238147 | A1* | 9/2010 | Huh | G09G 3/3233 345/205 |
| 2011/0050741 | A1 | 3/2011 | Jeong | |
| 2012/0194576 | A1* | 8/2012 | Matsui | G09G 3/3258 345/690 |
| 2012/0200611 | A1* | 8/2012 | Matsui | G09G 3/3233 345/690 |
| 2015/0187260 | A1* | 7/2015 | Lee | H01L 27/3272 345/77 |
| 2016/0267843 | A1* | 9/2016 | Wang | G09G 3/3233 |
| 2016/0372049 | A1 | 12/2016 | Wang et al. | |
| 2017/0039944 | A1 | 2/2017 | Ma et al. | |

FOREIGN PATENT DOCUMENTS

| | | | |
|---|---|---|---|
| CN | 103150991 | A | 6/2013 |
| CN | 104157240 | A | 11/2014 |
| CN | 104700776 | A | 6/2015 |
| CN | 105206221 | A | 12/2015 |
| EP | 1947633 | A2 | 7/2008 |

* cited by examiner

PIXEL COMPENSATION CIRCUIT, DRIVING METHOD THEREOF AND DISPLAY DEVICE

This application claims priority to and the benefit of Chinese Patent Application No. 201610006381.3 filed on Jan. 4, 2016, which application is incorporated herein in its entirety.

TECHNICAL FIELD

This application claims priority to and the benefit of Chinese Patent Application No. 201610006381.3 filed on Jan. 4, 2016, which application is incorporated herein in its entirety.

Embodiments of the present disclosure relate to a pixel compensation circuit, a driving method thereof and a display device.

BACKGROUND

With the continuous development of display technology, more and more organic light-emitting diode (OLED) display devices are applied in people's life. When the OLED display device displays an image, a display data voltage is inputted into a display of the OLED display device through a multiplexer, and the inputted display data voltage is stored in a data line capacitor corresponding to each column of pixel units on the display screen at first, then, the display data voltage is written into corresponding sub-pixel units by the data line capacitor, so that the image of the OLED display device can be displayed.

SUMMARY

According to at least one embodiment of the present disclosure, a pixel compensation circuit is provided, including: a signal input unit, a driving unit, a light-emitting control unit, a first reset unit, a second reset unit, a first storage capacitor, a first switching transistor and a second switching transistor, wherein the signal input unit is connected with an input of the first switching transistor; a signal write control line is connected with a control end of the first switching transistor; an output of the second switching transistor, the second reset unit and one end of the first storage capacitor are respectively connected with an output of the first switching transistor; the first reset unit and the driving unit are respectively connected with the other end of the first storage capacitor; an output of first reference voltage is connected with an input of the second switching transistor; a first scanning signal line is connected with a control end of the second switching transistor; a high-level output of a power supply, the driving unit and the light-emitting control unit are sequentially connected with one to another; a light-emitting control signal line is connected with the light-emitting control unit; and when a display data is written into the signal input unit, the signal write control line controls the first switching transistor to be switched on.

Embodiments of the present disclosure also provide a display device, including the pixel compensation circuit.

Embodiments of the present disclosure also provide a driving method of the pixel compensation circuit, including: in a reset period, a signal input unit does not operate; a driving unit does not operate; a light-emitting control unit does not operate; a signal write control line controls a first switching transistor to be switched off; a first scanning signal line controls a second switching transistor to be switched off; a first reset unit resets one end of a first storage capacitor connected with an end of the driving unit; a second reset unit resets one end of the first storage capacitor connected with the output of the first switching transistor; in a compensating period, the signal input unit does not operate; the driving unit begins to operate; the light-emitting control unit does not operate; the signal write control line controls the first switching transistor to be switched off; the first scanning signal line controls the second switching transistor to be switched on; both the first reset unit and the second reset unit stop resetting; the driving unit begins to operate, so that a high-level output of a power supply can charge the first storage capacitor; after the second switching transistor is switched on, an electric potential of one end of the first storage capacitor connected with the output of the first switching transistor is as a first reference voltage; in a display data write period, the signal input unit begins to operate; the driving unit does not operate; the light-emitting control unit does not operate; the signal write control line controls the first switching transistor to be switched on; the first scanning signal line controls the second switching transistor to be switched off; both the first reset unit and the second reset unit stop resetting; when the first switching transistor is switched on, the signal input unit begins to operate and to charge the first storage capacitor, so that the electric potential of one end of the first storage capacitor connected with the output of the first switching transistor is converted into a display data voltage written into the signal input unit; the driving unit and the first reset unit do not operate, so that one end of the first storage capacitor connected with the driving unit is in a floating state; and in a display period, the signal input unit does not operate; the driving unit begins to operate; the light-emitting control unit begins to operate; the signal write control line controls the first switching transistor to be switched off; the first scanning signal line controls the second switching transistor to be switched off; both the first reset unit and the second reset unit stop resetting; the driving unit operates in a saturation region and generates drive current; and the drive current drives the light-emitting control unit to emit light.

BRIEF DESCRIPTION OF THE DRAWINGS

Embodiments of the present disclosure will be described in more detail as below in conjunction with the accompanying drawings to enable those skilled in the art to understand the present disclosure more clearly, in which.

DETAILED DESCRIPTION

Figure 1:
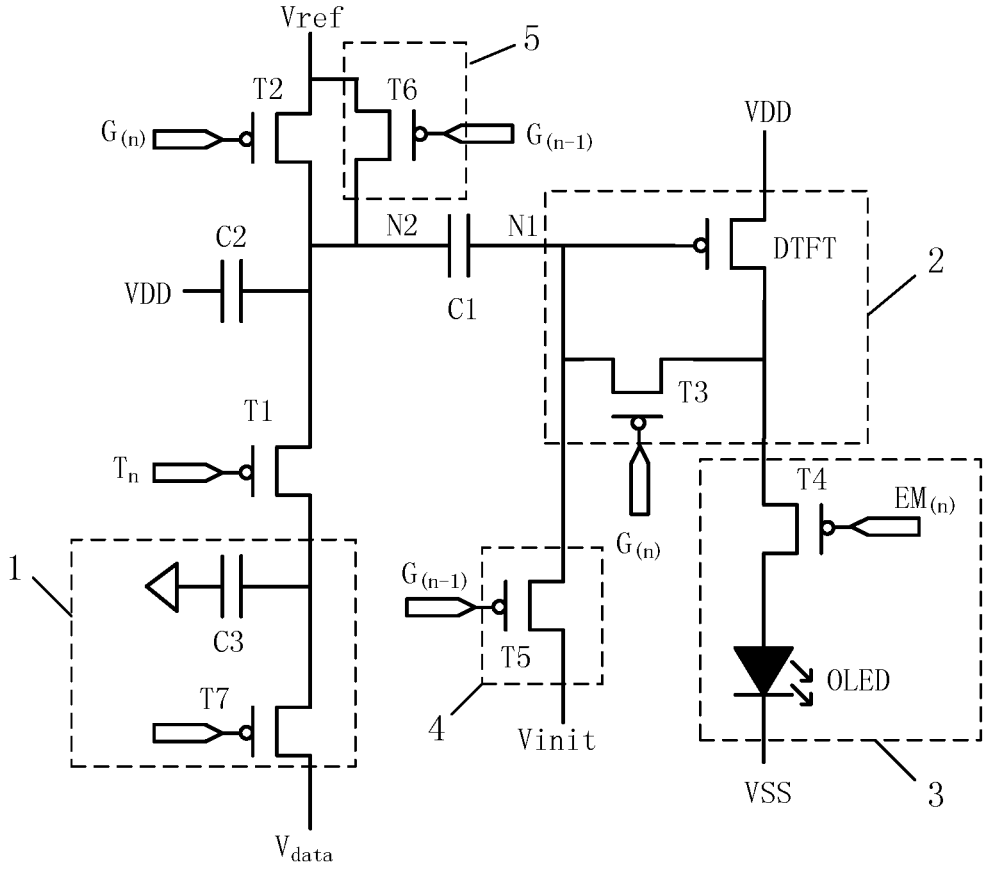
FIG. 1 is a schematic diagram of a pixel compensation circuit provided by an embodiment of the present disclosure.

Technical solutions according to the embodiments of the present disclosure will be described clearly and understandable as below in conjunction with the accompanying drawings of embodiments of the present disclosure. It is apparent that the described embodiments are only a part of but not all of exemplary embodiments of the present disclosure. Based on the described embodiments of the present disclosure, various other embodiments can be obtained by those of ordinary skill in the art without creative labor and those embodiments shall fall into the protection scope of the present disclosure.

Unless otherwise defined, all the technical and scientific terms used herein have the same meanings as commonly understood by one of ordinary skill in the art to which the present disclosure belongs. The terms, such as "first," "second," or the like, which are used in the description and the claims of the present application, are not intended to indicate any sequence, amount or importance, but for distinguishing various components. Also, the terms, such as "comprise/comprising," "include/including," or the like are intended to specify that the elements or the objects stated before these terms encompass the elements or the objects and equivalents thereof listed after these terms, but not preclude other elements or objects. The terms, "on," "under," or the like are only used to indicate relative position relationship, and when the position of the object which is described is changed, the relative position relationship may be changed accordingly.

The inventors found that in order to satisfy requirements of different consumers, shape of the display of the OLED display device is more and more diversified; as for some displays with special shapes (e.g., circular, oval and polygonal), the number of pixel units corresponding to each column on the display is different; as the number and the capacitance of parasitic capacitors corresponding to each pixel unit is same and the data line capacitor corresponding to each column of pixel units is created by the parallel connection of the parasitic capacitors corresponding to this column of pixel units, the capacitance of the data line capacitor corresponding to each column of pixel units on the display with special shape is different; in this case, when display data voltage is written into corresponding sub-pixel units through the data line capacitor, display data voltage which is actually written into the sub-pixel units is the result of the voltage dividing of the data line capacitor and the storage capacitor corresponding to the pixel unit; and when same display data are inputted into the display with special shape, thus the brightness of light emitted by different columns of pixel units is different.

Detailed description will be given below with reference to the drawings for further describing the pixel compensation circuit, the driving method thereof and the display device provided by embodiments of the present disclosure.

As shown in FIG. 1, the pixel compensation circuit provided by an embodiment of the present disclosure includes: a signal input unit 1, a driving unit 2, a light-emitting control unit 3, a first reset unit 4, a second reset unit 5, a first storage capacitor C1, a first switching transistor T1 and a second switching transistor T2. The signal input unit 1 is connected with an input of the first switching transistor T1; a signal write control line $T_n$ is connected with a control end of the first switching transistor T1; an output of the second switching transistor T2, the second reset unit 5 and one end of the first storage capacitor C1 are respectively connected with an output of the first switching transistor T1; the first reset unit 4 and the driving unit 2 are respectively connected with the other end of the first storage capacitor C1; an output of first reference voltage Vref is connected with an input of the second switching transistor T2; a first scanning signal line $G_{(n)}$ is connected with a control end of the second switching transistor T2; a high-level output of a power supply, the driving unit 2 and the light-emitting control unit 3 are sequentially connected with one to another; a light-emitting control signal line $EM_{(n)}$ is connected with the light-emitting control unit 3; and when display data are written into the signal input unit 1, the signal write control line $T_n$ controls the first switching transistor T1 to be switched on.

Detailed description will be given below to the operating procedure of the pixel compensation circuit with reference to FIGS. 1 and 2.

For better describing the operating procedure of the pixel compensation circuit, junctions of the output of the first switching transistor T1, the output of the second switching transistor T2, the second reset unit 5 and one end of the first storage capacitor C1 are defined to be N2 nodes, and junctions of the other end of the first storage capacitor C1, the first reset unit 4 and the driving unit 2 are defined to be N1 nodes.

Figure 2:
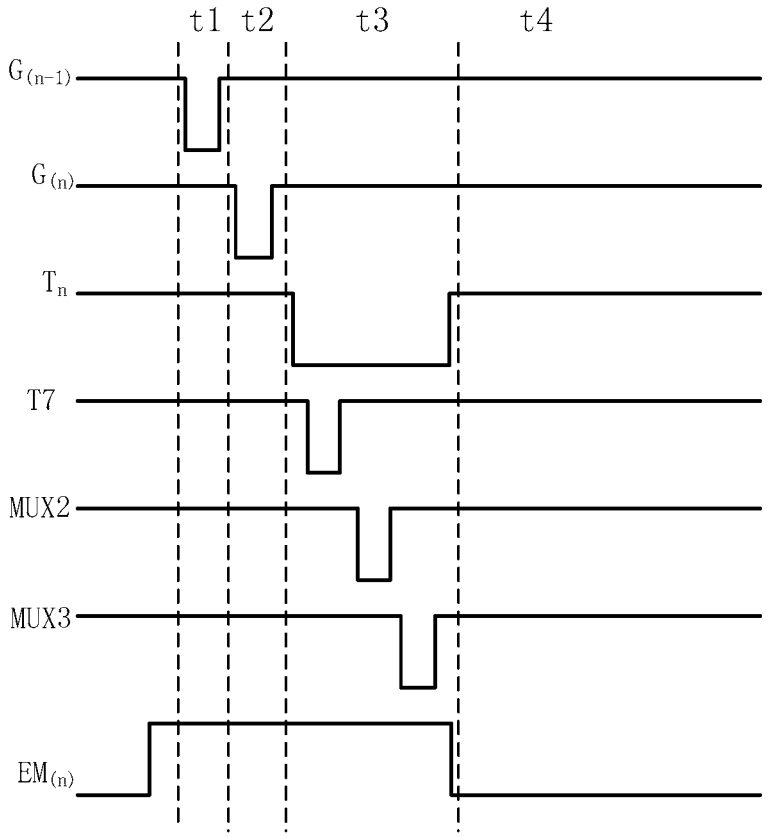
FIG. 2 is a signal timing sequence chart of a driving method of a pixel compensation circuit, provided by an embodiment of the present disclosure.

In the operation, in the t1 period as shown in FIGS. 1 and 2, the signal input unit 1 does not operate; the driving unit 2 does not operate; the light-emitting control signal line $EM_{(n)}$ controls the light-emitting control unit 3 to not operate; the signal write control line $T_n$ controls the first switching transistor T1 to be switched off; the first scanning signal line $G_{(n)}$ controls the second switching transistor T2 to be switched off; the first reset unit 4 is configured to reset the N1 nodes; and the second reset unit 5 resets the N2 nodes.

In the t2 period as shown in FIGS. 1 and 2, the signal input unit 1 does not operate; the driving unit 2 begins to operate; the light-emitting control signal line $EM_{(n)}$ controls the light-emitting control unit 3 to not operate; the signal write control line $T_n$ controls the first switching transistor T1 to be switched off; the first scanning signal line $G_{(n)}$ controls the second switching transistor T2 to be switched on; both the first reset unit 4 and the second reset unit 5 stop resetting; the driving unit 2 begins to operate, so that the high-level output of the power supply can charge the first storage capacitor T1; after the second switching transistor T2 is switched on, the output of the first reference voltage Vref charges the first storage capacitor C1, and the electric potential of the N2 nodes is converted into the first reference voltage Vref.

In the t3 period as shown in FIGS. 1 and 2, the signal input unit 1 begins to operate; the driving unit 2 does not operate; the light-emitting control signal line $EM_{(n)}$ controls the light-emitting control unit 3 to not operate; the signal write control line $T_n$ controls the first switching transistor T1 to be switched on; the first scanning signal line $G_{(n)}$ controls the second switching transistor T2 to be switched off; both the first reset unit 4 and the second reset unit 5 stop resetting; when the first switching transistor T1 is switched on, the signal input unit 1 begins to operate and charges the first storage capacitor C1, so that the electric potential of the N2 nodes is converted into display data voltage $V_{data}$ written into the signal input unit 1; and both the driving unit 2 and the first reset unit 4 do not operate, so that one end of the first storage capacitor C1 connected with the N1 node is in the floating state, and the electric potential of the N1 node responds to the jump in potential of the N2 node.

In the t4 period as shown in FIGS. 1 and 2, the signal input unit 1 does not operate; the driving unit 2 begins to operate; the light-emitting control signal line $EM_{(n)}$ controls the light-emitting control unit 3 to begin to operate; the signal write control line $T_n$ controls the first switching transistor T1 to be switched off; the first scanning signal line $G_{(n)}$ controls the second switching transistor T2 to be switched off; both the first reset unit 4 and the second reset unit 5 stop resetting;

and as the light-emitting control signal line $EM_{(n)}$ controls the light-emitting control unit 3 to begin to operate, in this case, the driving unit 2 operates in a saturation region and generates drive current $I_{oled}$, and the generated drive current $I_{oled}$ can drive the light-emitting control unit 3 to emit light.

In the pixel compensation circuit provided by the embodiment of the present disclosure, when the display data voltage $V_{data}$ is written into the signal input unit 1, the signal write control line $T_n$ can control the first switching transistor T1 to be switched on. In this way, after written into the signal input unit 1, the display data voltage $V_{data}$ can be directly output to the N2 node through the first switching transistor T1 by the signal input unit 1, and it is not required that the display data voltage $V_{data}$ is stored in the data line capacitor at first by the signal input unit 1 and then output to the N2 node by the data line capacitor. In this way, the display data voltage $V_{data}$ written into the signal input unit 1 can be completely output to the N2 node, which is not the result of voltage dividing of the data line capacitor corresponding to this column of pixel units and the storage capacitor corresponding to the pixel unit. That is to say, when a same display data voltage $V_{data}$ is inputted into a display with special shape, the brightness of light emitted by different columns of pixel units is same.

In addition, in the pixel compensation circuit provided by the embodiment of the present disclosure, other devices are not required to be arranged on the periphery of the pixel compensation circuit to completely and consistently compensate the capacitance of the data line capacitors corresponding to different columns of pixel units, so that the problem of non-uniform light emitted by the pixel units caused by different capacitance of the data line capacitors can be avoided, which can well satisfy the narrow-bezel development requirement of the OLED display device.

In the t4 period, the signal write control line $T_n$ controls the first switching transistor T1 to be switched off; the first scanning signal line $G_{(n)}$ controls the second switching transistor T2 to be switched off; and the second reset unit 5 stops resetting. In this way, one end of the first storage capacitor C1 connected with the N2 node is in the floating state. The floating state likely leads to a phenomenon of signal crosstalk in the pixel compensation circuit, and the display of the OLED display device can be abnormal. In order to avoid the crosstalk phenomenon, a second storage capacitor C2 is introduced into the pixel compensation circuit provided by the present embodiment; one end of the second storage capacitor C2 is connected with the high-level output of the power supply; the other end of the second storage capacitor C2 is connected with the output of the first switching transistor T1; the other end of the second storage capacitor C2 is connected with the output of the second switching transistor T2; and the other end of the second storage capacitor C2 is connected with one end of the first storage capacitor C1. After the second storage capacitor C2 is introduced in, one end of the first storage capacitor C1 connected with the N2 node is connected with the high-level output of the power supply through the second storage capacitor C2. In this case, even both the first switching transistor T1 and the second switching transistor T2 are switched off and the second reset unit 5 stops resetting, one end of the first storage capacitor C1 connected with the N2 node cannot be in the floating state, so that the crosstalk phenomenon can be well avoided.

Referring to FIG. 1 again, the driving unit 2 provided by the embodiment includes a driving switching transistor DTFT and a third switching transistor T3. A control end of the driving switching transistor DTFT is connected with an output of the third switching transistor T3; the control end of the driving switching transistor DTFT is connected with the first reset unit 4; the control end of the driving switching transistor DTFT is connected with the other end of the first storage capacitor C1; an input of the driving switching transistor DTFT is connected with the high-level output of the power supply; an output of the driving switching transistor DTFT is connected with an input of the third switching transistor T3; the output of the driving switching transistor DTFT is connected with the light-emitting control unit 3; and the first scanning signal line $G_{(n)}$ is connected with a control end of the third switching transistor T3. It is noted that the driving switching transistor DTFT has many types and may select P-channel thin film transistor (TFT) or N-channel TFT. When the P-channel TFT is selected as the driving switching transistor DTFT, the input of the driving switching transistor DTFT is a source electrode and the output of the driving switching transistor DTFT is a drain electrode.

In the t2 period, the first scanning signal line $G_{(n)}$ controls the third switching transistor T3 to be switched on, and the control end of the driving switching transistor DTFT is shorted with the output of the driving switching transistor DTFT, so that the driving switching transistor DTFT can have the characteristic of forward conduction of a common diode. When the driving switching transistor DTFT is in the on state, the high-level output of the power supply charges the first storage capacitor C1 through the driving switching transistor DTFT and the third switching transistor T3, and the electric potential $V_{n1}$ of the N1 node is converted into the sum of the supply voltage VDD and the threshold voltage $V_{th}$ of the driving switching transistor DTFT, namely Vn1=VDD+Vth. It is noted that when the driving switching transistor DTFT is an N-channel TFT, $V_{th}$ is a positive value; and when the driving switching transistor DTFT is a P-channel TFT, $V_{th}$ is a negative value.

In the t3 period, the signal input unit 1 operates; the first switching transistor T1 is switched on; and the display data voltage $V_{data}$ is written into corresponding pixel unit. At this point, the electric potential of the N2 node jumps from the first reference voltage Vref to the display data voltage $V_{data}$. Moreover, as the N1 node disposed on the other end of the first storage capacitor C1 is in the floating state at this point, according to the principle of charge conservation, the electric potential $V_{at}$ of the N1 node is converted into a sum of the supply voltage VDD, the threshold voltage $V_{th}$ and the display data voltage $V_{data}$ subtracts the first reference voltage Vref, namely $$V_{n1}=VDD+V_{th}+V_{data}-V\text{ref} \quad \text{Equation 1}$$

In the t4 period, the first scanning signal line $G_{(n)}$ controls the third switching transistor T3 to be switched off and the light-emitting control signal line $EM_{(n)}$ controls the light-emitting control unit 3 to begins to operate. Moreover, in this case, the driving unit 2 operates in the saturation region and generates the drive current $I_{oled}$. In addition, the voltage $V_{gs}$ between the control end of the driving switching transistor DTFT and the input of the driving switching transistor DTFT in the t4 period is:

$$V_{gs}=V_{n1}-VDD \quad \text{Equation 2}$$

Substituting the equation 1 in the equation 2, the result is:

$$V_{gs}=VDD+V_{th}+V_{data}-V\text{ref}-VDD=V_{th}+V_{data}-V\text{ref} \quad \text{Equation 3}$$

The computing equation of the drive current $I_{oled}$ is:

$$I_{oled}=\tfrac{1}{2}k(V_{gs}-V_{th}) \quad \text{Equation 4}$$

Substituting the equation 3 in the equation 4, the result is:

$$I_{oled}=\frac{1}{2}k(V_{th}+V_{data}-V\text{ref}-V_{th})^2=\frac{1}{2}k(V_{data}-V\text{ref})^2 \quad \text{Equation 5}$$

It is noted that k in the equation 4 and the equation 5 is a constant.

According to the equation 5, the drive current $I_{oled}$ is only related to the display data voltage $V_{data}$ and the first reference voltage Vref and is not related to the supply voltage VDD and the threshold voltage $V_{th}$. In this way, the influence of the attenuation of the supply voltage VDD on the drive current $I_{oled}$ and the influence of the threshold voltage $V_{th}$ on the drive current $I_{oled}$ can be avoided.

The light-emitting control unit 3 provided by the embodiment includes a fourth switching transistor T4 and a light-emitting component. A control end of the fourth switching transistor T4 is connected with the light-emitting control signal line $EM_{(n)}$; an input of the fourth switching transistor T4 is connected with the output of the driving switching transistor DTFT; the input of the fourth switching transistor T4 is connected with the input of the third switching transistor T3; an output of the fourth switching transistor T4 is connected with an positive pole of the light-emitting component; and a negative pole of the light-emitting component is connected with a common ground VSS.

In the t1, t2 and t3 periods as shown in FIG. 2, the driving unit 2 may generate the drive current $I_{oled}$, but the generated drive current $I_{oled}$ is not the drive current required by the light-emitting component. Thus, in the t1, t2 and t3 periods, the light-emitting control signal line $EM_{(n)}$ controls the fourth switching transistor T4 to be switched off, so that the light-emitting component and the driving unit 2 can be in the isolated state, and the problem of flicker due to error driving of the light-emitting component can be avoided, or the problem that the service life of the light-emitting component is affected by high driving frequency can be avoided. In the t4 period as shown in FIG. 2, the light-emitting control signal line $EM_{(n)}$ controls the fourth switching transistor T4 to be switched on, so that the drive current $I_{oled}$ can directly drive the light-emitting component to emit light, and the OLED display device can display an image. It is noted that the light-emitting component has many types, and mostly used light-emitting component is an OLED, but the embodiments of the present disclosure are not limited thereto.

Referring to FIG. 1 again, the structures of the first reset unit 4 and the second reset unit 5 can be many types, so that the reset function of the first reset unit 4 and the second reset unit 5 can be achieved. The structures of the first reset unit 4 and the second reset unit 5 will be given below for describing the operating procedure of the first reset unit 4 and the second reset unit 5.

The first reset unit 4 includes a fifth switching transistor T5; the second reset unit 5 includes a sixth switching transistor T6; a control end of the fifth switching transistor T5 and a control end of the sixth switching transistor T6 are respectively connected with a second scanning signal line; an output of second reference voltage Vinit is connected with an input of the fifth switching transistor T5; an output of the fifth switching transistor T5 is connected with the control end of the driving switching transistor DTFT; the output of the fifth switching transistor T5 is connected with the output of the third switching transistor T3; the output of the fifth switching transistor T5 is connected with the other end of the first storage capacitor C1; the output of the first reference voltage Vref is connected with an input of the sixth switching transistor T6; an output of the sixth switching transistor T6 is connected with the output of the second switching transistor T2; the output of the sixth switching transistor T6 is connected with the output of the first switching transistor T1; and the output of the sixth switching transistor T6 is connected with one end of the first storage capacitor C1.

In the t1 period as shown in FIG. 2, the second scanning signal line $G_{(n-1)}$ controls the fifth switching transistor T5 and the sixth switching transistor T6 to be switched on, so that the electric potential of the N1 node can be reset to be the second reference voltage Vinit by the output of the second reference voltage Vinit through the fifth switching transistor T5, and the electric potential of the N2 node can be reset to be the first reference voltage Vref by the output of the first reference voltage Vref through the sixth switching transistor T6. Moreover, both the first reference voltage Vref and the second reference voltage Vinit are stable DC voltage, namely they will not have phenomenon, such as attenuation, or instability.

Figure 3:
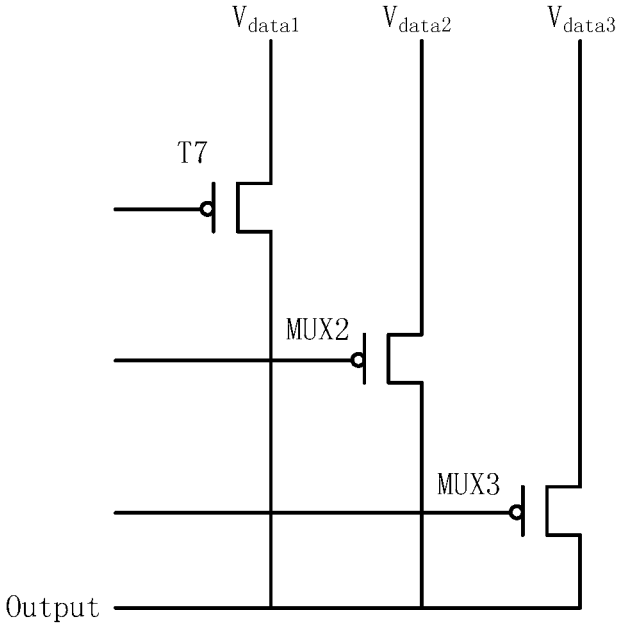
FIG. 3 is a schematic structural view of a multiplexer in an embodiment of the present disclosure.

In the t3 period as shown in FIGS. 1 and 2, the signal input unit 1 may have many structures. For example, it may be formed by an independent switching transistor and a parasitic capacitor C3, and may also be formed by partial switching transistors in a multiplexor (MUX) and the parasitic capacitor C3. As shown in FIG. 3, when the MUX is selected to provide data signal voltage for the pixel compensation circuit, one switching transistor in the MUX is selected to form a signal input unit with the parasitic capacitor C3. For instance, the signal input unit includes a seventh switching transistor T7 and the parasitic capacitor C3; a display data line is connected with an input of the seventh switching transistor T7; an output of the seventh switching transistor T7 is connected with one end of the parasitic capacitor C3; the output of the seventh switching transistor T7 is connected with the input of the first switching transistor T1; the other end of the parasitic capacitor C3 is connected with the common ground VSS; and the seventh switching transistor T7 is controlled to be switched on by a control signal connected with the control end of the seventh switching transistor T7 in the MUX, so that the display data voltage $V_{data}$ can be written into the pixel compensation circuit.

Simple description will be given below to the use method of the multiplexor. For example, a 1:3 multiplexor is used in this case. In the t3 period, the signal write control line $T_n$ controls the first switching transistor T1 to be switched on. When the first switching transistor T1 is switched on, the multiplexor controls the seventh switching transistor T7, an eighth switching transistor MUX2 and a ninth switching transistor MUX3 therein to be switched on sequentially, so that corresponding first display data voltage $V_{data1}$, second display data voltage $V_{data2}$ and third display data voltage $V_{data3}$ can be sequentially output to the N2 nodes of corresponding pixel units through the first switching transistor T1.

It is noted that the first switching transistor T1, the second switching transistor T2, the third switching transistor T3, the fourth switching transistor T4, the fifth switching transistor T5, the sixth switching transistor T6, the seventh switching transistor T7, the eighth switching transistor MUX2, the ninth switching transistor MUX3 and the driving switching transistor DTFT in the embodiment may be P-channel TFTs or other elements capable of achieving the function of a controllable switch, e.g., N-channel TFTs. Moreover, the type of the switching transistors in the same pixel compensation circuit may be same or different, and corresponding timing sequence high and low level can be adjusted according to the characteristics of the threshold voltage $V_{th}$. In addition, the pixel compensation circuit provided by the embodiments of the present disclosure can be easily modified into a circuit formed by other elements having the function of controllable switches based on the basic principle of the present pixel compensation circuit. However, no matter what kinds of elements are adopted to achieve the driving function of the circuit, the embodiments use such elements shall fall within the scope of the present disclosure.

When the first switching transistor T1, the second switching transistor T2, the third switching transistor T3, the fourth switching transistor T4, the fifth switching transistor T5, the sixth switching transistor T6 and the seventh switching transistor T7 are all P-channel TFTs, corresponding voltage (control end voltage) for driving the first switching transistor T1, the second switching transistor T2, the third switching transistor T3, the fourth switching transistor T4, the fifth switching transistor T5, the sixth switching transistor T6 and the seventh switching transistor T7 to be switched on is all in a low level; the inputs of the switching transistor T1, the second switching transistor T2, the third switching transistor T3, the fourth switching transistor T4, the fifth switching transistor T5, the sixth switching transistor T6 and the seventh switching transistor T7 are all source electrodes; the outputs are all drain electrodes; and the control ends are all gate electrodes.

Description will be given below based on some examples.

Figure 4:
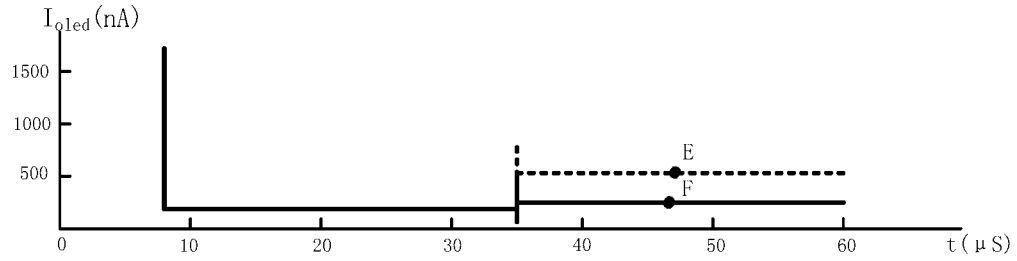
FIG. 4 is a simulating result diagram of drive current corresponding to different data line capacitors.
Figure 5:
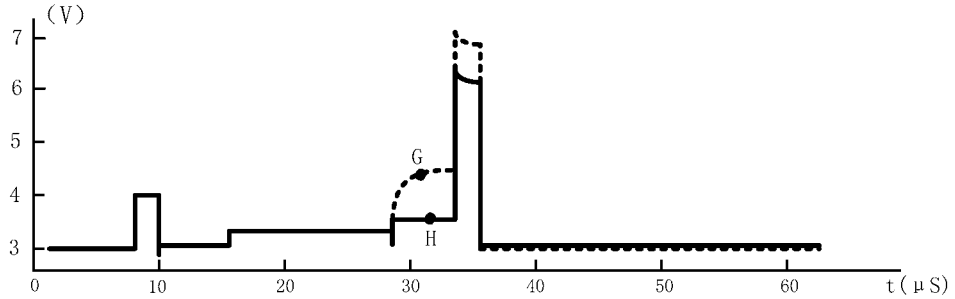
FIG. 5 is a simulating result diagram of electric potential of N2 nodes corresponding to different data line capacitors.
Figure 6:
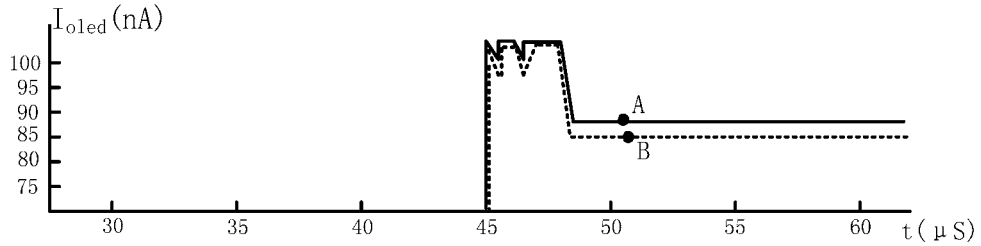
FIG. 6 is a simulating result diagram of drive current corresponding to different data line capacitors in an embodiment of the present disclosure.
Figure 7:
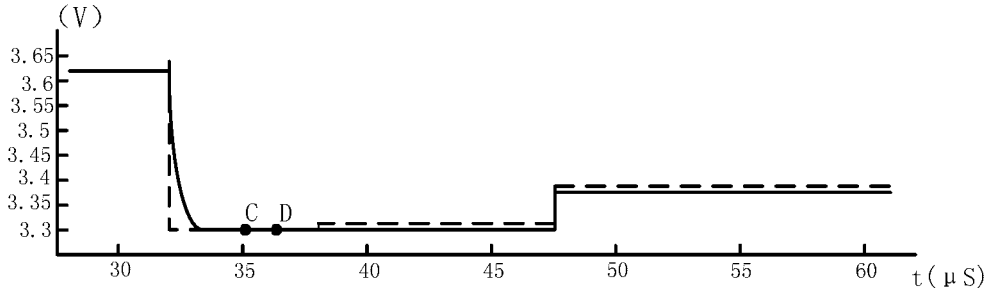
FIG. 7 is a simulating result diagram of electric potential of N2 nodes corresponding to different data line capacitors in an embodiment of the present disclosure.

For instance, data line capacitors with the two capacitances 0.5 pF and 8 pF are selected; the drive current $I_{oled}$ and the electric potential of the N2 node are respectively subjected to simulation according to the difference between the pixel compensation circuit in the prior art and the pixel compensation circuit provided by an embodiment of the present disclosure. As shown in FIGS. 4 to 7, respectively, the dotted line in each figure represents the case that the capacitance of the data line capacitor is 0.5 pF and the solid line in each figure represents the case that the capacitance of the data line capacitor is 8 pF. It is noted that the x-coordinate in FIGS. 4 to 7 represents time and the unit is μS, respectively; the y-coordinate in FIGS. 4 and 6 represents drive current $I_{oled}$ and the unit is nA, respectively; and the y-coordinate in FIGS. 5 and 7 represents electric potential of the N2 node and the unit is V, respectively.

The coordinate of an E point in FIG. 4 is (X, Y)=(47.02, 507) and the coordinate of an F point is (X, Y)=(46.84, 78), namely when the capacitance of the data line capacitor is 0.5 pF and 8 pF, respectively, the drive current $I_{oled}$ corresponding to the E point and the F point is respectively 507 nA and 78 nA. The coordinate of an A point in FIG. 6 is (X, Y)=(50.68, 88) and the coordinate of a B point is (X, Y)=(50.80, 86), namely when the capacitance of the data line capacitor is 0.5 pF and 8 pF, respectively, the drive current $I_{oled}$ corresponding to the A point and the B point is respectively 88 nA and 86 nA.

According to the comparison of the simulation results of the FIGS. 4 and 6, for data line capacitors with different capacitances, the difference of the drive current $I_{oled}$ corresponding to the pixel compensation circuit provided by the embodiment of the present disclosure is significantly less than the difference of the drive current $I_{oled}$ corresponding to the pixel compensation circuit in the prior art. It is noted that the period corresponding to the simulation results of FIGS. 4 and 6 is the same working period of the two pixel compensation circuits.

The coordinate of a G point in FIG. 5 is (X, Y)=(31.26, 4.5) and the coordinate of an H point is (X, Y)=(31.53, 3.6), namely when the capacitance of the data line capacitor is 0.5 pF and 8 pF, respectively, the potential electric of the N2 node corresponding to the G point and the H point is respectively 4.5V and 3.6V. The coordinate of a C point in FIG. 7 is (X, Y)=(35.07, 3.3) and the coordinate of a D point is (X, Y)=(36.29, 3.3), namely when the capacitance of the data line capacitor is 0.5 pF and 8 pF, respectively, the electric potential of the N2 node corresponding to the C point and the D point is respectively 3.3V and 3.3V.

According to the comparison of the simulation results of FIGS. 5 and 7, for the data line capacitors with different capacitances, the display data voltage $V_{data}$ of the pixel compensation circuit provided by the present disclosure can be completely written into corresponding pixel unit, namely the electric potential of the N2 node corresponding to the pixel compensation circuit is equal to the display data voltage $V_{data}$. The difference is significantly less than the difference of the electric potential of the N2 node of the pixel compensation circuit in the prior art. It is noted that the timing period corresponding to the simulation results of FIGS. 5 and 7 is the same working period of the two pixel compensation circuits.

Therefore, according to the comparison of the simulation results, the pixel compensation circuit provided by the embodiments of the present disclosure can well avoid the problem of different brightness of light emitted by the pixel units due to different capacitance of the data line capacitor corresponding to each column of pixel units in the display panel.

The embodiments of the present disclosure also provide a display device, which includes the pixel compensation circuit. As the pixel compensation circuit can well avoid the problem of different brightness of light emitted by the pixel units due to different capacitance of the data line capacitor corresponding to each column of pixel units in the display panel, during an images are displayed, the display device provided by the embodiments of the present disclosure can avoid the problem of different brightness of displayed images due to different capacitance of the data line capacitor corresponding to each column of pixel units in the display panel.

The embodiments of the present disclosure also provide a driving method of a pixel compensation circuit, which is used for driving the pixel compensation circuit and includes:

In the reset period, namely in the t1 period as shown in FIGS. 1 and 2, the signal input unit 1 does not operate; the driving unit 2 does not operate; the light-emitting control signal line $EM_{(n)}$ controls the light-emitting control unit 3 to not operate; the signal write control line $T_n$ controls the first switching transistor T1 to be switched off; the first scanning signal line $G_{(n)}$ controls the second switching transistor T2 to be switched off; the first reset unit 4 resets the N1 nodes; and the second reset unit 5 resets the N2 node.

In the compensating period, namely in the t2 period as shown in FIGS. 1 and 2, the signal input unit 1 does not operate; the driving unit 2 begins to operate; the light-emitting control signal line $EM_{(n)}$ controls the light-emitting control unit 3 to not operate; the signal write control line $T_n$ controls the first switching transistor T1 to be switched off; the first scanning signal line $G_{(n)}$ controls the second switching transistor T2 to be switched on; both the first reset unit 4 and the second reset unit 5 stop resetting; the driving unit 2 begins to operate, so that the high-level output of the power supply can charge the first storage capacitor T1; after the second switching transistor T2 is switched on, the output of the first reference voltage Vref charges the first storage capacitor C1, and the electric potential of the N2 nodes is converted into the first reference voltage Vref.

In the display data write period, namely in the t3 period as shown in FIGS. 1 and 2, the signal input unit 1 begins to operate; the driving unit 2 does not operate; the light-emitting control signal line $EM_{(n)}$ controls the light-emitting control unit 3 to not operate; the signal write control line $T_n$ controls the first switching transistor T1 to be switched on; the first scanning signal line $G_{(n)}$ controls the second switching transistor T2 to be switched off; both the first reset unit 4 and the second reset unit 5 stop resetting; when the first switching transistor T1 is switched on, the signal input unit 1 begins to operate and charges the first storage capacitor C1, so that the electric potential of the N2 nodes is converted into a display data voltage $V_{data}$ written into the signal input unit 1; and both the driving unit 2 and the first reset unit 4 do not operate, so that one end of the first storage capacitor C1 connected with the N1 node is in the floating state, and the electric potential of the N1 node responds to the jump in potential of the N2 node.

In the display period, namely in the t4 period as shown in FIGS. 1 and 2, the signal input unit 1 does not operate; the driving unit 2 begins to operate; the light-emitting control signal line $EM_{(n)}$ controls the light-emitting control unit 3 to begin to operate; the signal write control line $T_n$ controls the first switching transistor T1 to be switched off; the first scanning signal line $G_{(n)}$ controls the second switching transistor T2 to be switched off; both the first reset unit 4 and the second reset unit 5 stop resetting; and as the light-emitting control signal line EM(n) controls the light-emitting control unit 3 to begin to operate, in this case, the driving unit 2 operates in a saturation region and generates drive current $I_{oled}$, and the generated drive current $I_{oled}$ can drive the light-emitting control unit 3 to emit light.

Description is given in the embodiments of the description by a progressive manner; same and similar parts of the embodiments may refer to each other; and those different from other embodiments are emphasized in each embodiment. For example, as method embodiments are basically similar to product embodiments, the method embodiments are simply described and relevant parts refer to the description of the product embodiments.

The driving unit 2 provided by the embodiments includes a driving switching transistor DTFT and a third switching transistor T3. A control end of the driving switching transistor DTFT is connected with an output of the third switching transistor T3; the control end of the driving switching transistor DTFT is connected with the first reset unit 4; the control end of the driving switching transistor DTFT is connected with the other end of the first storage capacitor C1; an input of the driving switching transistor DTFT is connected with the high-level output of the power supply; an output of the driving switching transistor DTFT is connected with an input of the third switching transistor T3; the output of the driving switching transistor DTFT is connected with the light-emitting control unit 3; and the first scanning signal line $G_{(n)}$ is connected with a control end of the third switching transistor T3.

In the compensating period, the first scanning signal line $G_{(n)}$ controls the third switching transistor T3 to be switched on, and the control end of the driving switching transistor DTFT is shorted with the output of the driving switching transistor DTFT, so that the driving switching transistor DTFT can have the characteristic of forward conduction of a common diode, namely the driving switching transistor enters the saturation state. After the driving switching transistor DTFT is switched on, the high-level output of the power supply charges the first storage capacitor C1 through the driving switching transistor DTFT and the third switching transistor T3, and the electric potential $V_{n1}$ of the N1 node is converted into the sum of the supply voltage VDD and the threshold voltage $V_{th}$ of the driving switching transistor DTFT.

In the description of the embodiments, the features, structures, materials or characteristics may be combined by appropriate manners in any one or more embodiments or examples.

In the pixel compensation circuit provided by the embodiment of the present disclosure, when the display data voltage is written into the signal input unit, the signal write control line can control the first switching transistor to be switched on. In this way, after written into the signal input unit, the display data voltage can be directly output to one end of the first storage capacitor connected with the output of the first switching transistor, through the first switching transistor, and it is not required that the display data voltage is stored in the data line capacitor at first by the signal input unit and then output to one end of the first storage capacitor connected with the output of the first switching transistor, by the data line capacitor. In this way, the display data voltage written into the signal input unit can be completely output to one end of the first storage capacitor connected with the output of the first switching transistor, instead of a result of voltage dividing of the data line capacitor corresponding to this column of pixel units and the storage capacitor corresponding to the pixel unit. That is to say, when same display data are input into a display panel with special shape, the brightness of light emitted by different columns of pixel units is same.

In addition, in the pixel compensation circuit provided by the embodiments of the present disclosure, other devices are not required to be arranged on the periphery of the pixel compensation circuit to completely and consistently compensate the capacitance of the data line capacitors corresponding to different columns of pixel units, so the problem of non-uniform light emitted by the pixel units caused by different capacitance of the data line capacitors can be avoided, and it can well satisfy the narrow-bezel development requirement of the OLED display device.

The described above are just exemplary embodiments to explain the principle of the present disclosure and the disclosure is not intended to be limited thereto. An ordinary person in the art can make various variations and modifications to the present disclosure without departure from the spirit and the scope of the present disclosure, and such variations and modifications shall fall in the scope of the present disclosure.

The present application claims benefit of and priority to the Chinese Patent Application No. 201610006381.3 filed in SIPO on Jan. 4, 2016 and entitled "Pixel compensation circuit, Driving Method thereof and Display Device", which is incorporated herein by reference in its entirety.

What is claimed is:

1. A pixel compensation circuit, comprising: a signal input circuit, a driving circuit, a light-emitting control circuit, a first reset circuit, a second reset circuit, a first storage capacitor, a first switching transistor, and a second switching transistor, wherein the signal input circuit is connected with an input of the first switching transistor; a signal write control line is connected with a control end of the first switching transistor; an output of the second switching transistor, the second reset circuit, and one end of the first storage capacitor are connected with an output of the first switching transistor; the first reset circuit and the driving circuit are connected with an other end of the first storage capacitor; an output of the first reference voltage is connected with an input of the second switching transistor; a first scanning signal line is connected with a control end of the second switching transistor; a high-level output of a power supply, the driving circuit, and the light-emitting control circuit are sequentially connected with one to another; a light-emitting control signal line is connected with the light-emitting control circuit; and when a display data is written into the signal input circuit, the signal write control line controls the first switching transistor to be switched on, wherein the driving circuit includes a driving switching transistor and a third switching transistor, in which a control end of the driving switching transistor is connected with an output of the third switching transistor; the control end of the driving switching transistor is connected with the first reset circuit; the control end of the driving switching transistor is connected with the other end of the first storage capacitor; an input of the driving switching transistor is connected with the high-level output of the power supply; an output of the driving switching transistor is connected with an input of the third switching transistor; the output of the driving switching transistor is connected with the light-emitting control circuit; and the first scanning signal line is connected with a control end of the third switching transistor.

2. The pixel compensation circuit according to claim 1, wherein the light-emitting control circuit includes a fourth switching transistor and a light-emitting component, in which a control end of the fourth switching transistor is connected with the light-emitting control signal line; an input of the fourth switching transistor is connected with the output of the driving switching transistor; the input of the fourth switching transistor is connected with the input of the third switching transistor; an output of the fourth switching transistor is connected with a positive pole of the light-emitting component; and a negative pole of the light-emitting component is connected with a common ground terminal.

3. The pixel compensation circuit according to claim 2, wherein the first reset circuit includes a fifth switching transistor; the second reset circuit includes a sixth switching transistor; a control end of the fifth switching transistor and a control end of the sixth switching transistor are connected with a second scanning signal line;

an output of second reference voltage is connected with an input of the fifth switching transistor; an output of the fifth switching transistor is connected with the control end of the driving switching transistor; the output of the fifth switching transistor is connected with the output of the third switching transistor; the output of the fifth switching transistor is connected with the other end of the first storage capacitor; and the output of the first reference voltage is connected with an input of the sixth switching transistor; an output of the sixth switching transistor is connected with the output of the second switching transistor; the output of the sixth switching transistor is connected with the output of the first switching transistor; and the output of the sixth switching transistor is connected with the one end of the first storage capacitor.

4. The pixel compensation circuit according to claim 3, wherein the signal input circuit includes a seventh switching transistor and a parasitic capacitor, in which a display data line is connected with an input of the seventh switching transistor; an output of the seventh switching transistor is connected with one end of the parasitic capacitor; the output of the seventh switching transistor is connected with the input of the first switching transistor; and an other end of the parasitic capacitor is connected with the common ground terminal.

5. The pixel compensation circuit according to claim 4, wherein the first switching transistor, the second switching transistor, the third switching transistor, the fourth switching transistor, the fifth switching transistor, the sixth switching transistor, the seventh switching transistor, and the driving switching transistor are all P-channel thin-film transistors (TFTs).

6. A display device, comprising the pixel compensation circuit according to claim 1.

7. A driving method of the pixel compensation circuit according to claim 1, comprising:

in a reset period, the signal input circuit does not operate; the driving circuit does not operate; the light-emitting control circuit does not operate; the signal write control line controls the first switching transistor to be switched off; the first scanning signal line controls the second switching transistor to be switched off; the first reset circuit resets one end of the first storage capacitor connected with an end of the driving circuit; the second reset circuit resets one end of the first storage capacitor connected with an output of the first switching transistor;

in a compensating period, the signal input circuit does not operate; the driving circuit begins to operate; the light-emitting control circuit does not operate; the signal write control line controls the first switching transistor to be switched off; the first scanning signal line controls the second switching transistor to be switched on; both the first reset circuit and the second reset circuit stop resetting; the driving circuit begins to operate, so that a high-level output of a power supply can charge the first storage capacitor; after the second switching transistor is switched on, an electric potential of the one end of the first storage capacitor connected with the output of the first switching transistor is as a first reference voltage;

in a display data write period, the signal input circuit begins to operate; the driving circuit does not operate; the light-emitting control circuit does not operate; the signal write control line controls the first switching transistor to be switched on; the first scanning signal line controls the second switching transistor to be switched off; both the first reset circuit and the second reset circuit stop resetting; when the first switching transistor is switched on, the signal input circuit begins to operate and to charge the first storage capacitor, so that the electric potential of the one end of the first storage capacitor connected with the output of the first switching transistor is converted into a display data voltage written into the signal input circuit; the driving circuit and the first reset circuit do not operate, so that the one end of the first storage capacitor connected with the driving circuit is in a floating state; and in a display period, the signal input circuit does not operate; the driving circuit begins to operate; the light-emitting control circuit begins to operate; the signal write control line controls the first switching transistor to be switched off; the first scanning signal line controls the second switching transistor to be switched off; both the first reset circuit and the second reset circuit stop resetting; the driving circuit operates in a saturation region and generates a drive current; and the drive current drives the light-emitting control circuit to emit light.

8. The driving method of the pixel compensation circuit according to claim 7, wherein in the compensating period, the first scanning signal line controls the third switching transistor to be switched on, so that the driving switching transistor enters a saturation state, and the high-level output of the power supply charges the first storage capacitor.

9. A pixel compensation circuit, comprising: a signal input circuit, a driving circuit, a light-emitting control circuit, a first reset circuit, a second reset circuit, a first storage capacitor, a first switching transistor, a second switching transistor, and a second storage capacitor, wherein the signal input circuit is connected with an input of the first switching transistor; a signal write control line is connected with a control end of the first switching transistor; an output of the second switching transistor, the second reset circuit, and one end of the first storage capacitor are connected with an output of the first switching transistor; the first reset circuit and the driving circuit are connected with an other end of the first storage capacitor; an output of a first reference voltage is connected with an input of the second switching transistor; a first scanning signal line is connected with a control end of the second switching transistor; a high-level output of a power supply, the driving circuit, and the light-emitting control circuit are sequentially connected with one to another; a light-emitting control signal line is connected with the light-emitting control circuit;

one end of the second storage capacitor is connected with the high-level output of the power supply; an other end of the second storage capacitor is connected with the output of the first switching transistor; the other end of the second storage capacitor is connected with the output of the second switching transistor; and the other end of the second storage capacitor is connected with the one end of the first storage capacitor; and when a display data is written into the signal input circuit, the signal write control line controls the first switching transistor to be switched on, wherein the driving circuit includes a driving switching transistor and a third switching transistor, in which a control end of the driving switching transistor is connected with an output of the third switching transistor; the control end of the driving switching transistor is connected with the first reset circuit; the control end of the driving switching transistor is connected with the other end of the first storage capacitor; an input of the driving switching transistor is connected with the high-level output of the power supply; an output of the driving switching transistor is connected with an input of the third switching transistor; the output of the driving switching transistor is connected with the light-emitting control circuit; and the first scanning signal line is connected with a control end of the third switching transistor.

10. The pixel compensation circuit according to claim 9, wherein the light-emitting control circuit includes a fourth switching transistor and a light-emitting component, in which a control end of the fourth switching transistor is connected with the light-emitting control signal line; an input of the fourth switching transistor is connected with the output of the driving switching transistor; the input of the fourth switching transistor is connected with the input of the third switching transistor; an output of the fourth switching transistor is connected with a positive pole of the light-emitting component; and a negative pole of the light-emitting component is connected with a common ground.

11. The pixel compensation circuit according to claim 10, wherein the first reset circuit includes a fifth switching transistor; the second reset circuit includes a sixth switching transistor; a control end of the fifth switching transistor and a control end of the sixth switching transistor are connected with a second scanning signal line;

an output of second reference voltage is connected with an input of the fifth switching transistor; an output of the fifth switching transistor is connected with the control end of the driving switching transistor; the output of the fifth switching transistor is connected with the output of the third switching transistor; the output of the fifth switching transistor is connected with the other end of the first storage capacitor; and the output of the first reference voltage is connected with an input of the sixth switching transistor; an output of the sixth switching transistor is connected with the output of the second switching transistor; the output of the sixth switching transistor is connected with the output of the first switching transistor; and the output of the sixth switching transistor is connected with the one end of the first storage capacitor.

12. The pixel compensation circuit according to claim 11, wherein the signal input circuit includes a seventh switching transistor and a parasitic capacitor, in which a display data line is connected with an input of the seventh switching transistor; an output of the seventh switching transistor is connected with one end of the parasitic capacitor; the output of the seventh switching transistor is connected with the input of the first switching transistor; and an other end of the parasitic capacitor is connected with the common ground.

13. The pixel compensation circuit according to claim 12, wherein the first switching transistor, the second switching transistor, the third switching transistor, the fourth switching transistor, the fifth switching transistor, the sixth switching transistor, the seventh switching transistor, and the driving switching transistor are P-channel TFTs.

* * * * *